United States Patent [19]

Pfaffmann

[11] Patent Number: 4,791,259

[45] Date of Patent: Dec. 13, 1988

[54] METHOD AND APPARATUS FOR RETAINING A VALVE SEAT INSERT

[75] Inventor: George D. Pfaffmann, Farmington, Mich.

[73] Assignee: Tocco, Inc., Boaz, Ala.

[21] Appl. No.: 87,507

[22] Filed: Aug. 20, 1987

Related U.S. Application Data

[63] Continuation-in-part of Ser. No. 007,798, Jan. 28, 1987, abandoned.

[51] Int. Cl.[4] ..... H05B 6/10

[52] U.S. Cl. ..... 219/10.43; 219/10.57; 148/145; 148/150; 29/157.1 R; 29/447; 123/188 S

[58] Field of Search ..... 219/10.41, 10.43, 10.49 R, 219/10.57, 10.493; 148/145, 146, 150, 143, 127; 29/157.1 R, 157.1 A, 447; 123/188 S

[56] References Cited

U.S. PATENT DOCUMENTS

| | | | |
|---|---|---|---|
| Re. 29,046 | 11/1976 | Delpaggio | 219/10.57 |
| 2,017,154 | 10/1935 | Larkin | 123/188 |
| 3,378,412 | 4/1968 | Mansfield et al. | 148/130 |
| 3,789,180 | 1/1974 | Cachat | 219/10.57 |
| 4,336,432 | 6/1982 | Bajorek | 219/10.41 |
| 4,438,310 | 3/1984 | Cachat | 219/10.43 |
| 4,469,530 | 9/1984 | Wyss et al. | 148/16.5 |
| 4,497,673 | 2/1985 | Esser | 148/447 |
| 4,643,781 | 1/1987 | Vickers et al. | 148/127 |
| 4,675,488 | 6/1987 | Mucha et al. | 219/10.43 |

*Primary Examiner*—Philip H. Leung

*Attorney, Agent, or Firm*—Body, Vickers & Daniels

[57] ABSTRACT

A method of heat treating a valve seat insert and the resultant combination of the valve seat insert within an engine component is disclosed where the volumetric increase of a portion of the valve seat insert resulting from the heat treatment is utilized to maintain or increase the insert retention forces.

28 Claims, 2 Drawing Sheets

METHOD AND APPARATUS FOR RETAINING A VALVE SEAT INSERT

This is a continuation-in-part of Ser. No. 007,798, filed Jan 28, 1987, now abandoned.

This invention relates generally to a method of induction heat treating and the apparatus combination resulting therefrom, and more particularly to an in situ induction heat treating method applied to one element of a two part combination and the effect on the combination thereof.

The invention is particularly applicable to and will be described with particular reference to the heat treating of valve seat inserts applied to cylinder heads of internal combustion engines. However, the invention in its broader aspects may be utilized in any type of apparatus where a heat treated element must be specifically orientated and retained against a second abutting element by means of an interference fit.

BACKGROUND

The valve seats in internal combustion engine heads are conventionally induction hardened surfaces which provide increased service life through reduction of wear at the valve-valve seat interface. This may be achieved by seats formed integrally within the cylinder head or by means of valve seat inserts which are retained in countersunk valve bores which open to the combustion chambers formed in the cylinder head. In particular, inserts are necessary for use with aluminum cylinder heads. Many different approaches have been taken to produce a hardened valve seat which can be inserted in a very precise accurate manner in a cylinder head on an automotive assembly line.

In one approach, the valve seat of the insert is heat treated prior to assembly and is thereafter press fitted into the valve bores of the cylinder head. The pre-hardened insert approach has generally been found to be unsatisfactory because the insert cannot be accurately positioned with the proper orientation within the valve bore. Accordingly, the insert, in a hardened state, must be machine finished or "dressed" to achieve the proper geometrical sealing relationship with the poppet valve. Such finishing operations include either surface grinding or special tooling for surface generated cutting actions. This is time consuming and costly and in turn generates heat which could, conceivably, adversely affect the hardness on the seat of the insert.

To overcome such problems, the conventional approach in use today has been to install the valve seat inserts in the cylinder heads in a metallurgically soft condition and then accurately machine the valve seat inserts by means of relatively simple machining operations to achieve the precise orientation of the insert's valve seating surface relative to the cylinder head. Thereafter, the valve seat insert is heat treated to produce the desired hardness. The heat treat operations typically use an induction heater to heat the insert to the austenitic temperature followed by rapid cooling at a rate equal to the critical cooling rate to produce a sufficient martensitic structure to meet the required hardness. Cooling at the critical rate has been conventionally achieved by using the massive cylinder head to act as a heat sink.

While this approach is fundamentally sound, in practice, and especially for those applications where cast iron inserts are inserted into aluminum cylinder heads, different rates of thermal expansion (and thermal elastic temperature limits) which exist between cast iron and aluminum could result in a partial (or even complete) loss of the insert retention force, which was produced when the insert was pressed into the countersunk valve bore, during the heating operation. The problem can be especially aggravated when it is considered that during operation of the engine, the heat, especially from the exhaust gases passing by the exhaust valve in addition to the block heat, can produce a further lessening of the retention force between the insert and the countersunk valve bore because of the different thermal expansion coefficients between the cylinder head and the insert. The problem is further aggravated when it is considered that the insert is subjected to an impact loading by the valve as it opens and closes and such shock forces could act, if the retention fit has been significantly reduced, to pry the insert loose. Accordingly, a number of approaches have been proposed to address such problems.

One such proposal, which is especially pertinent to my invention, is shown in U.S Pat. No. 4,336,432. In the '432 Patent, a significant initial retention-force is effected between the insert and the cylinder head valve bore by cryogenically cooling (usually by liquid nitrogen) the insert prior to assembly into the cylinder head bore to establish a shrink fit. Once the cryogenic has established the high preload or retention force, essentially normal utilization of induction heating apparatus at relatively short time cycles and high frequencies produces an acceptable martensitic structure on the seat of the insert while maintaining an adequate preload or retention force between the insert and the countersunk valve bore in the cylinder head. While the process shown in the '432 Patent produces a successful insert-head retention fit, it is not all together satisfactory from a commercial viewpoint, simply because cryogenic assembly is costly, time consuming and difficult to automate. The automation aspect becomes particularly troublesome when an assembly line is employed which processes both cast in place as well as separate valve seat inserts.

SUMMARY OF THE INVENTION

Accordingly, it is a principal feature of my invention to utilize an in situ, induction heat treating method which establishes an acceptable retention force between a valve seat insert and a cylinder head bore after an initial preload or retention force is established by conventionally press fitting the valve seat insert into the countersunk valve bore.

This feature along with other objects of the invention is achieved by an in place assembly or an in situ heat treatment effected on a valve seat insert having an initial or non-heat treated configuration or condition and a final or heat treated condition or configuration. The conventional cylinder head which receives the valve seat insert has at least one combustion chamber with at least one cylindrical, countersunk valve bore opening in the head which communicates with the combustion chamber. The countersunk valve bore is defined by an annular base and an outer cylindrical wall. The insert which, in its initial condition, is press fitted into the countersunk valve bore, has a bottom annular base surface in contact with the bore's annular base, a smaller top annular surface and a cylindrical outer surface extending between the insert's top and bottom annular surfaces which are in contact with the cylindrical wall of the countersunk valve bore. The insert also has a frusto-conical seat surface which extends between the top annular surface and a converging frusto-conical surface which terminates at the bottom annular surface of the insert. As noted, the insert is press fitted into the countersunk valve bore in its initial condition. An induction heater is then used to carefully control the heating of the valve seat insert so that a predetermined volume of the insert extending from the frusto-conical valve seat surface of the insert to some position or distance inside the insert is at a temperature at least equal to the austenitic temperature of the insert. More precisely, the insert is heated until a precise percentage of its volume is at the austenitic temperature of the insert's material and the insert is then quenched so that the entire volume of the insert which was heated to the austenitic temperature cools at a substantially uniform rate at least equal to the critical cooling rate of the insert. The martensitic structure thus produced in the austenitically heated portion of the insert will result in an attendant volumetric increase of the insert in its heat treaded condition which will place the unheated portion of the insert in a tensile strain condition and the heated portion of the insert in a compressive strain condition. By controlling the volme of the insert which has undergone the phase transformation to the volume of the insert which has not undergone a phase transformation, the tensile stress on the unheated or virgin metal portion of the insert can be controlled so that the elastic limit of the valve seat is not exceeded and the insert expands against the softer, more yieldable cylindrical cylindrical wall of the cylinder head to maintain or increase the retention forces.

In accordance with another aspect of the invention, the induction heating is controlled to produce an unstable heat pattern within the insert which is nevertheless regulated so that if there is any variation in the cooling rate in the volume of the insert which is heated above the austenitic temperature, martensite will be formed initially at the frusto-conical seat surface prior to the martensite being formed within the insert. While this normally would produce stress cracks in conventional heat treating procedures, the austenite at the innermost portion of the insert will adjust to the martensitic transformation at the frusto-conical surface until it, in turn, transforms to martensite at which time the less brittle, unhardened portion of the insert will elastically expand to avoid stress cracks at the valve seat surface. Further to this feature, it is contemplated that the microscopic martensite formation pattern as described will occur when utilizing high frequencies to achieve skin heating of the frusto-conical valve seat surface whereby the temperature of the valve seat surface is at a higher value than the austenitic temperature in the interior of the insert because the frusto-conical valve seat surface will cool faster than the interior. In other application it may be necessary to have the valve seat insert at lower frequencies so that a higher temperature will result at some distance away from the frusto-conical seat surface to insure that the frustoconical seat surface cools at a rate equal to or greater than the internally heated portion of the insert.

In accordance with another aspect of the invention, an alternative embodiment is disclosed which is characterized by a blind annular recess which extends radially inwardly in the valve seat insert from the outer cylindrical surface of the insert. The recess, typically in the form of a blind annular groove, can take various shapes and configurations. Preferably, the interference fit of the recessed insert is greater than that of the interference fit of the solid insert described above so that the annular groove will be somewhat initially distorted when press fitted into the countersunk valve bore of the cylinder head although the retention force of the solid insert and the grooved insert would be at similar force levels. Induction heating at a short time cycle is then used to heat a portion or a predetermined volume of the insert to the austenitic temperature. The volume of the insert which is heated extends radially outwardly from the frustoconical surface to a distance which is sufficient to at least contact the base surface of the annular groove but does not extend to the outer cylindrical surface of the insert. The insert is then quenched to form the martensitic structure in that volume of the insert which was heated above the austenitic temperature. The volumetric increase in mass resulting from the formation of the martensite results in a further distortion or deformation of the groove. The groove distortion acts on the principal of a leverage arm, to increase or at least maintain the initial preload or retention force between the insert and the countersunk valve bore. It is contemplated that applications for this embodiment would exist for small valve inserts where maintaining the proper ratio of hardened to unhardened insert masses might be difficult to achieve or where a cast iron insert would be inserted in a cast iron cylinder head which has a lesser tendency than an aluminum head to elastically deform.

In accordance with yet a still further aspect of the invention, the valve seat insert can be modified at the intersection of its annular base surface with its outer cylindrical wall surface to provide a chamber or frusto-conical surface parallel to the frusto-conical seat surface so that the cross-sectional width of the insert is maintained at a relatively constant dimension. In this configuration, the strin produced by the martensitic expansion will be uniformly transmitted to that volume of the insert which did not undergo a phase transformation. The induction heating of the insert would thus be easier to control and the retention forces between the outer cylindrical surface of the insert and the outer cylindrical wall of the countersunk valve bore in the cylinder head would be uniformly applied along the contact area.

It is thus possible to simply press fit a valve insert into a cylinder head bore at ambient temperatures, and inductively heat, for a short time at high frequency, the insert's valve seat surface to produce an efficient and economical processing combination which is easily adapted to manufacturing production lines where valve seats, either integral or inserts, are to be assembled and heat treated in cylinder heads of similar or dissimilar materials.

Accordingly, an object of the present invention is the provision of a valve seat insert assembly having increased, post heat treatment retention forces.

Another object of the invention is the provision of a machinable and heat treatable valve seat not requiring cryogenic assembly procedures.

A further object is the provision of a hardenable valve seat insert which is press fitted into an engine component counterbore to establish an initial compression loading and which is subsequently heat treated to desired hardness to provide an increase in the compression loading.

Still another object is the provision of an engine component having valve seat inserts which may be processed interchangeably with engine components having integral valve seats of similar or dissimilar materials.

Yet another object of the invention is the provision of a method for heat treating valve seat inserts utilizing the volumetric increase during the austenitic-martensitic transformation to effect an increase in the insert retention force.

These and other objects and advantages and features of the invention will become apparent in the following description taken together with the accompanying drawings which are described in the following section.

DETAILED DESCRIPTION OF THE PREFERRED EMBODIMENT

Figure 1:
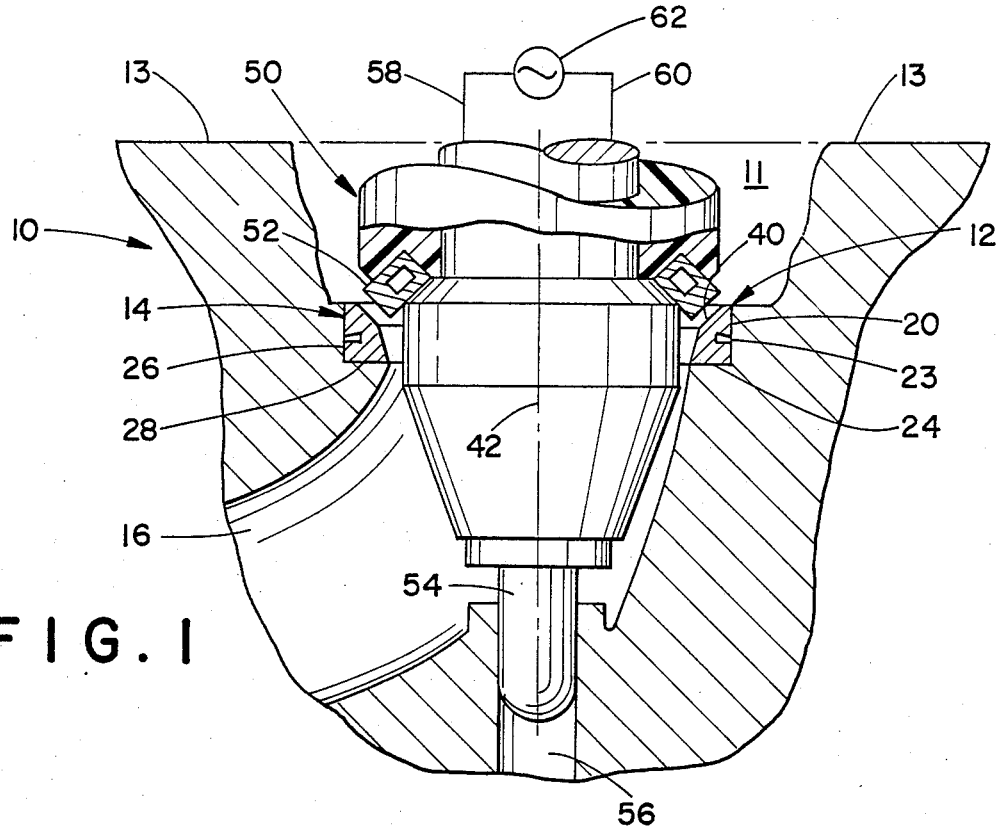
FIG. 1 is a fragmentary cross-sectional view of an exhaust valve showing an inductor in heating relationship with the valve seat insert and is generally similar to that disclosed in the parent application, Ser. No. 007,798, filed Jan. 28, 1987.

Referring now to the drawings wherein the showings are for the purposes of illustrating the preferred embodiment and alternative embodiments of the invention only and are not for the purpose of limiting the same, FIG. 1 shows an engine component 10, which is the cylinder head of an internal combustion engine, which in turn has a valve seat insert 12 retained in a countersunk valve bore 14 which defines a valve port 16. For orientation purposes, valve port 16 is in fluid communication with a combustion chamber 11 of cylinder head 10 and combustion chamber 11 terminates at a flat mounting surface 13 whereby cylinder head 10 is traditionally bolted to the cylinder block of an internal combustion engine. In conventional engine operation, a poppet valve, not shown, reciprocates with respect to valve seat insert 12 to control the flow of intake and exhaust gases to and from associated combustion chambers 11. To insure proper control of the gas flow during engine operation, it is important that the valve seat insert's seating surface be accurately orientated with respect to the seating surface of the valve head which reciprocally moves into and out of contact with valve seat insert 12. Accordingly, to provide an acceptable service life, the insert must be hardened to resist wear. Thus, valve seat insert 12 must be formed from a suitable, hardenable ferrous material such as stainless steel, cast iron, sintered iron or the like.

Figure 2:
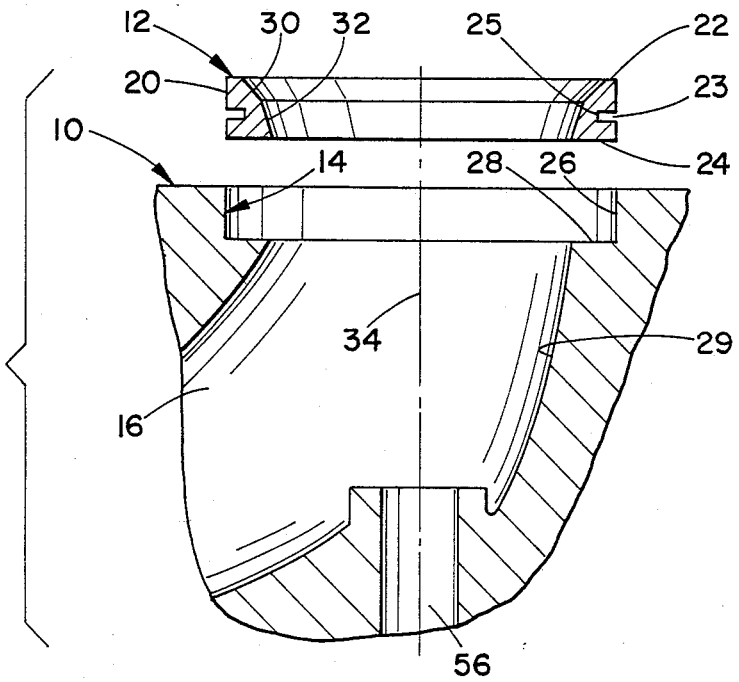
FIG. 2 is an enlarged exploded cross-sectional view of the insert and engine component prior to assembly and is generally identical to that disclosed in the parent application.

As best shown in FIG. 2, the valve seat insert 12 is defined by an outer cylindrical wall surface 20, an annular top wall surface 22 at the top of outer cylindrical wall surface 20 and an annular bottom wall surface 24 at the bottom of outer cylindrical wall surface 20. A frustoconical valve seat surface 30 intersects annular top wall surface 22 and a converging frusto-conical surface 32 which in turn intersects annular bottom wall surface 24. Converging frusto-conical surface 32 could functionally be replaced by an inner cylindrical surface. The angle of frusto-conical valve seat surface 30 is typically 45° with respect to centerline 34 although, as conventionally known, the angle of frustoconical valve seat surface 30 is determined by the angle on the exhaust or the intake valves head. In the preferred embodiment of my invention, valve seat insert 12 is solid and has the configuration thus described. In an alternative embodiment of my invention recess means 23 are provided which extend inwardly (generally radially although not necessarily in a radial direction) from outer cylindrical wall surface 20. The countersunk valve bore 14 is also best shown in FIG. 2 and is defined by an outer cylindrical wall 26 which intersects at its bottom with an annular base wall 28 which in turn terminates at a generally cylindrical wall 29 in the valve port 16. Obviously, valve seat insert 12 fits within countersunk valve bore 14 and the geometry, as defined for valve seat insert 12 and countersunk valve bore 14, is general in that certain surfaces can be modified so long as the proper angle of frusto-conical valve seat surface 30 is maintained once valve seat insert 12 is positioned within countersunk valve bore 14. Nevertheless, to provide the highest retention forces between valve seat insert 12 and countersunk valve bore 14 it is believed necessary to maintain a cylindrical relationship of outer cylindrical wall surface 20 and outer cylindrical wall 26. By conventional press means, valve seat insert 12 is mechanically pressed into countersunk valve bore 14 until annular bottom wall surface 24 engages annular base wall 28. To provide an initial compressive loading between cylinder head 10 and valve seat insert 12, the diameter of outer cylindrical wall surface 20 is slightly larger than the diameter of outer cylindrical wall 26. Generally, the interference is in the ragne of 0.002 to 0.007" for a ½" diameter insert. More specifically, for inserts of the preferred embodiment which do not possess recess means 23, the interference is in the general range of 0.002 to 0.005" and for ½" diameter inserts which do possess recess means 23, the interference will be slightly larger, typically in the range of 0.003 to 0.007" for reasons which will subsequently be explained. Despite the differences in range, the retention force generated by the interference fits for the preferred and alternative embodiments would be about equal. Importantly, the interference must be sufficient to establish a sufficiently high preload so that valve seat insert 12 will not become loose during either the subsequent machining operations or the heat treating operation or the normal valve service operation conditions.

Figure 3:
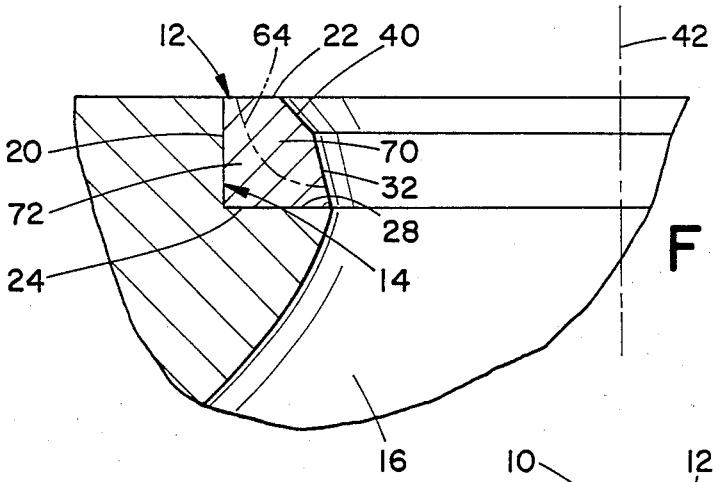
FIG. 3 is an enlarged fragmentary view of the insert showing the martensitic distribution following heat treatment and is generally identical to that disclosed in the parent application.

After valve seat insert 12 is inserted into countersunk valve bore 14, conventional apparatus, not shown, is employed to finish frusto-conical valve seat surface 30 to its proper finished form which is designated as numeral 40 in FIG. 3. Finished frusto-conical valve seat surface 40 has the desired complimentary angularity with respect to the interfacing surface of the poppet valve in an accurately concentrically located position with respect to the assembly axis 42 thus compensating for any valve-to-valve manufacturing irregularities as well as any inconsistencies in the press fit orientation or valve seat insert 12 within the countersunk valve bore 14.

Referring now to FIG. 1, subsequent to machining, the frusto-conical valve seat surface 30 is inductively heated by means of a conventional inductor 50. Inductor 50 includes a single loop inductor coil 52 which is concentrically located with respect to assembly axis 42 by means of an entry nose 54 which enters a valve stem bore 56 concentric with assembly axis 42 and contiguous with the lower surface of valve port 16. Known positioning devices are used with inductor 50 to accurately space inductor coil 52 with respect to finished frusto-conical valve seat surface 40. Reference may be had to U.S. Pat. No. Re. 29,046 for a more detailed description of a suitable inductor 50 and positioning device which can be utilized in my invention. Inductor coil 52 includes leads 58 and 60 connected to a high frequency power supply shown schematically at 62.

The invention will now be explained by first considering the various factors which must be controlled during the heat treating of valve seat insert 12 to produce the desired retention fit between valve seat insert 12 and countersunk valve bore 14.

In the induction heating art it is known that a band of heat in an unstable pattern can be generated at any point or position on or within the valve seat insert 12 as desired. Factors which influence the heat band which is developed include the size or power of the power supply 62, the position or closeness of inductor coil 52 relative to valve seat insert 12, the time of heating and the freuency at which the power supply 62 is operated. It is also possible to use more than one frequency cycle such as disclosed in my prior U.S. Pat. No. 4,675,488 issued June 23, 1987 incorporated herein by reference, which, if applied to heating valve seat insert 12 would involve time cycles of millisecond durations. In any event, it is possible to generate within valve seat insert 12 an unstable band of heated material at a temperature equal to or in excess of the critical temperature of insert 12 (i.e. the temperature at which the ferrous material undergoes a phase transformation from a body centered to a face centered cubic structure) at which austenite is formed.

The second factor to be considered is the cooling rate of the band of the insert which has been heated to or above the austenitic temperature. The cooling rate must be equal to or exceed the critical cooling rate to avoid the formation of any pearlite or bainite and the temperature at which the insert is cooled must preferably drop beyond the martensite start temperature and as close to the martensite finish temperature as is practically possible to avoid the presence of any significant amount of retained austenite and achieve the desired hardness, typically about Rc 65. In practice, such cooling rates can be achieved as soon as power supply 62 is deenergized. This occurs because the heat pattern generated is unstable to begin with. That is, because the time at which the inductor coil 52 is left on is not sufficient to establish a stable pattern, dissipation will rapidly occur. Secondly, the exterior surfaces of valve seat insert 12 will be rapidly cooled by the ambient temperature of the air surrounding valve seat insert 12. Finally, the mass of cylinder head 10, in and of itself, provides a heat sink which will cool valve seat insert 12 by conduction. In certain applications, principally those involving larger valve seat inserts 12, inductor 50 may be equipped with water spray quench openings for spraying water on valve seat insert 12 after heating to achieve a water quench.

The third factor to be addressed is the thermal expansion of valve seat insert 12 and outer cylindrical wall 26 of countersunk valve bore 14 in cylinder head 10. Thermal expansion becomes an especially critical problem when dissimilar metals are involved such as a cast iron valve seat insert 12 within an aluminum cylinder head 10 since aluminum expands significantly more than cast iron for any given temperature. The different expansion rates as illustrated in the graph shown in U.S. Pat. No. 4,336,432 reduces the retention forces. However, the critical factor is that the stresses produced in the material resulting from the thermal expansion must not exceed the elastic limit or modulus of elasticity of the material and that the retention forces during expansion are not significantly reduced so that the orientation of valve seat insert 12 can be properly maintained. In this connection, it should also be noted that when an aluminum cylinder head 10 is utilized, the press fit assembly of valve seat insert 12 into countersunk valve bore 14 established a plastic deformation of outer cylindrical wall 26 with an attendant reduction of the elastic limit of the aluminum in this localized area.

The fourth and most critical factor in the heat treat analysis is the sizing of the area or volume of valve seat insert 12 which is heated to or above the austenitic temperature to that area or volume of valve seat insert 12 which is not heated to the austenitic temperature. As is conventionally known, when a ferrous metal is heated to or above its austenitic temperature and rapidly quenched to produce martensite, the formation of the martensitic structure is accompanied with an attendant grain growth resulting in a volumetric increase of the metal typically between 1 and 2% sssuming that a significant percentage of martensite versus martensite and retained austenite is formed. In a traditional analysis of a typical problem encountered in the martensitic transformation, a round bar is thoroughly heated throughout to the austenitic temperature and quenched at or above its critical cooling rate. Because martensite is somewhat less dense than the parent austenite, a slight expansion of the bar initially occurs near the surface because the surface of the bar reaches the martensitic transformation range before the central region or area of the bar reaches the transformation. Thus, the adjacent austenite which has not yet transformed is strained to match the volumetric change occuring at the surface of the bar without significant stresses in the austenite. However, once the central region of the bar undergoes transformation, the surface area of the bar is placed in tension as a result of the volume increase of the central region of the bar with the result that quench cracks occur. This principal is the basis upon which my invention is predicated. Essentially, I balance all four factors to produce a martensitic structure at finished frusto-conical valve seat surface 40 which results in a volumetric increase which is absorbed by the expansion of the remaining, virgin metal of valve seat insert 12.

Figure 4:
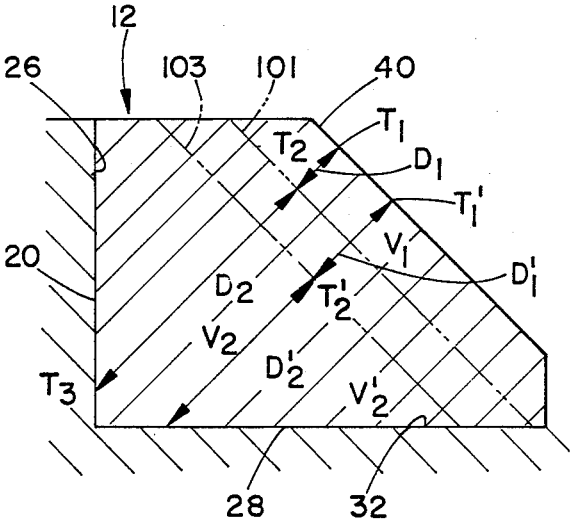
FIG. 4 is a partial fragmentary cross-sectional view of the preferred embodiment of the valve seat insert applied to the countersunk valve bore of the cylinder head.

Referring now to FIG. 4, there is shown a cross-sectional configuration of a standard solid valve seat insert 12 which is the preferred embodiment of my invention. A dot dash line 101 generally parallel to frusto-conical valve seat surface 40 and at a distance $D_1$ between phantom line 101 and frusto-conical valve seat surface 40 defines an area or more precisely a volume $V_1$ which is heated to or slightly above the austenitic temperature of valve seat insert 12. Uniformly quenching at the critical cooling rate or above, at least on a macroscopic scale, the $V_1$ volume will result in a martensitic expansion which will place the virgin metal shown as $V_2$ and defined as the distance from phantom line 101 to outer cylindrical wall surface 20. So long as the elastic limit of the virgin metal in volume $V_2$ is not stressed beyond its elastic limit, the virgin metal will expand as opposed to the martensitic volume $V_1$ which is under compression. Preferably, this will more likely occur when $D_1$ is greater than $D_2$ or $V_1$ is greater than $V_2$ and the expansion will, to some extent, be absorbed by the aluminum outer cylindrical wall 26 which, as noted for aluminum, is softer than the cast iron valve seat insert 12. For this to occur, the ratio of the martensitic volume $V_1$ to the virgin metal volume $V_2$ must be proportioned so that the grain growth in volume $V_1$ does not strain the virgin metal in volume $V_2$ beyond its elastic limit. Importantly, the cooling rate throughout volume $V_1$ is constant so that only the virgin metal volume $V_2$ is placed under tension and not any portion of the martensitic volume $V_1$ especially that at frusto-conical valve seat surface 40 to avoid stress cracks, prevent any dimensional distortion of frusto-conical valve seat surface 40 and to obtain the full benefit of the martensitic expansion. On a microscopic analysis, some portion of volume $V_1$ will transform to martensite before some other portion and it is my intent, contrary to conventional teachings, to have frusto-conical valve seat surface 40 transform to martensite before the innermost portion of volume $V_1$, represented by phantom line 101, transforms to martensite Thus, for larger valve seat inserts 12, where the heat sink effect of cylinder head 10 might not be as significant as on smaller valve seat inserts 12 and consequently the cooling by the ambient air is controlling, I would preferably employ induction heating techniques known as skin heating to raise the temperature of frusto-conical valve seat surface 40, i.e. $T_1$, to a higher temperature than the austenitic temperature which would exist at phantom line 101 designated as $T_2$. Conversely, on a smaller valve seat insert 12 where the heat sink effects of cylinder head 10 might be more significant than the ambient air, I might employ a different frequency and power source to initially generate a heat band spaced inwardly from finished frusto-conical valve seat surface 40. This is schematically shown by the prime (') letters shown in FIG. 4 which represent similar designations for dimensions, volumes, etc. Thus, where the heating initially begins inwardly of frusto-conical seat surface 40, $T_1'$ and $T_2'$ will be heated to at least the austenitic temperature while the temperature $T_2$ which might exist at phantom line 101 (where the initial heating band occurs) would be higher than the temperature $T_1$ to insure, as closely as possible, that the martensite transformation occurs (on a microscopic scale) in time first at frusto-conical valve seat surface 40. As shown in FIG. 4, the volume $V_1'$ at a distance of $D_1'$ would represent the martensitic band and the volume $V_2'$. Furthermore, phantom lines 101 and 103 are shown as generally straight in FIG. 4 for convenience only. In practice, phantom lines 101 and 103 will assume an irregular path but somewhat parallel to frusto-conical seat surface 40. Finally, whichever heating technique is employed as determined for each application by the cooling rate achieved in the martensitic volume $V_1$, $V_1'$, the temperature conducted by valve seat insert 12 to cylinder head 10 at outer cylindrical wall 26, designated at $T_3$, $T_3'$ in the drawings, cannot exceed a thermally induced expansion stress in the cylinder head material which exceeds the elastic limit of that material nor which results in an expansion of that material such that the preload or the retention force established by the press fit is reduced significantly or approaches zero.

Figure 6:
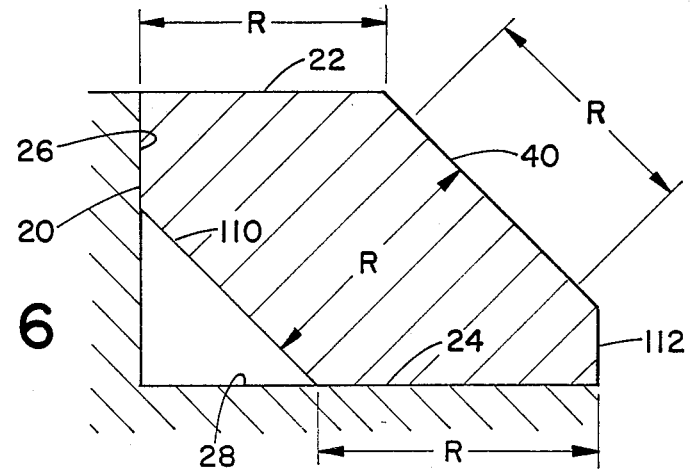
FIG. 6 show a modification of the value seat insert shown in FIG. 4.

A modification of the solid insert shown in FIG. 4 is illustrated in FIG. 6 in which a chamber or frusto-conical surface 110 is formed generally parallel to finished frustoconical valve seat surface 40 at the intersection of outer cylindrical wall 26 with annular base wall 28. Specifically, so that a constant cross-section is obtained in valve seat insert 12 for better controlling the volume ratios $V_1$, $V_2$, the length of finished frusto-conical valve seat surface 40 may be increased and converging frusto-conical surface 32 may be replaced by an inner cylindrical surface 112 so that the radial distance of annular top wall surface 22 is equal to the radial distance of annular bottom wall surface 24 which in turn is approximately equal to the distance between chamber 110 and finished frusto-conical valve seat surface 40.

Figure 5:
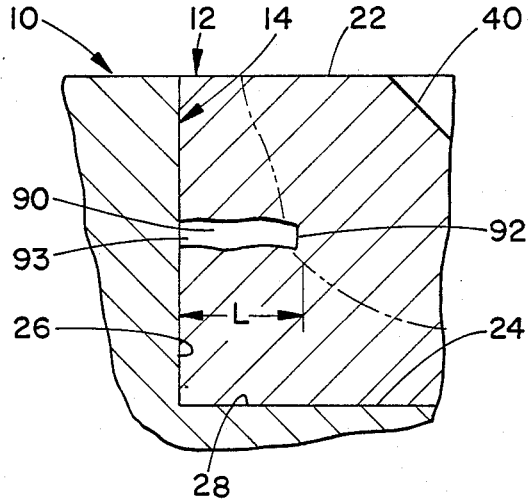
FIG. 5 shows an embodiment of the grooved valve seat insert, generally identical to that disclosed in the parent application.

As noted in the description of FIGS. 1 and 2 and as shown in FIG. 5, an alternative embodiment of the invention is to provide recess means 23 typically in the form of an annular groove extending from outer cylindrical wall surface 20 to some distance within valve seat insert 12. As noted above, the interference fit for valve seat inserts 12 which employ recess means 23 is slightly greater than the solid valve seat inserts 12 of the preferred embodiment. The increase in the interference fit will cause a slight deformation within the recess when recess means 23 is an annular groove such as 90 as shown in FIG. 5. More specifically, the width of annular groove 90 at its opening 93 at outer cylindrical wall surface 20 should narrow or close somewhat. Importantly, recess means 23 extends a distance L into valve seat insert 12 so that the base of the groove such as 92 as shown in FIG. 5 intersects, contacts or extends into the martensitic volume $V_1$ formed in valve seat insert 12. When the volumetric expansion takes place within volume $V_1$, annular groove 90 will further distort, principally at its base 92 which tends to open its open end 93 to increase the retention pressure between valve seat insert 12 and cylinder head 10. Preferably, the deformation of annular groove 90 will act on a lever arm principal to increase the retention forces with the lever arm generally equal to the length "L" of annular groove 90. It is contemplated that the alternative embodiment illustrated in FIG. 5 may have preferred application where a cast iron va1ve seat insert 12 is applied to a cast iron cylinder head 10 in that the deformation of annular groove 90 is more likely to occur and because it is anticipated that the martensitic volumetric expansion would be resisted more by the harder cast iron material than that of aluminum cylinder heads 10. Also, the alternative embodiment illustrated in FIG. 5 may have application for smaller sized valve seat inserts 12 where it might be difficult to control the ratios of austenitically heated volume $V_1$ to virgin metal volume $V_2$. While an annular groove 90 is illustrated in FIG. 5, obviously further variations such as helical grooves, variable width grooves and combinations thereof can be obtained and lowering resistance to volumetric diametric expansion imposed.

Having thus described my invention, it is apparent that many modifications may be incorporated into the insert and the specifics of any given heat treat cycle may considerably vary without departing from the spirit or essence of the invention. It is my intention to include all such modifications and alterations insofar as they come within the scope of the present invention.

It is thus the essence of my invention to control the heat treating of an insert so that the attendant volumetric increase of a portion of the insert resulting from the martensitic transformation may be utilized to increase the retention fit of the insert with an adjacent, abutting element.

Having thus defined my invention, I claim:

1. In combination, a cylinder head and an annular valve seat insert heat treated, in situ, from an initial condition to a heat treated condition by induction heating, said cylinder head having at least one combustion chamber, a cylindrical, countersunk valve bore in said head in communication with said combustion chamber, said counter-sunk valve bore defined by an annular base and an outer cylindrical wall extending therefrom; said insert within said bore having a bottom annular base surface in contact with said annular base, a smaller top annular surface, a generally cylindrical outer surface extending between said top and bottom annular surfaces in contact with said outer cylindrical wall and a frusto-conical seat surface extending from said top annular surface towards said bottom annular base surface; the improvement comprising:

said initial condition established solely by a press fit condition at ambient temperature, said insert further having an annular blind recess extending from said outer surface towards said seat surface, said recess being deformed in said initial condition by said press fit condition;

said insert having a first volume of a substantially martensitic grain structure defined by a cross-sectional configuration of said insert extending a predetermined first distance from said frusto-conical seat surface towards said outer cylindrical wall, a second volume of a substantially non-martensitic grain structure defined by a cross-sectional configuration extending a predetermined second distance from said cylindrical outer surface towards said frusto-conical valve seat surface;

said first volume greater in said heat treated condition than in said initial condition and extending to at least a portion of said recess to cause a further deformation in said recess, said volumetric increase and said recess deformation sufficient to maintain said outer cylindrical surface tightly against said outer cylindrical wall.

2. The combination of claim 1 wherein said first distance is greater than said second distance.

3. The combination of claim 1 wherein said insert in said heat treated condition is characterized by the absence of surface cracks.

4. The combination of claim 1 wherein said cylinder head is aluminum.

5. The combination of claim 4 wherein said insert is cast iron.

6. The combination of claim 5 wherein said outer cylindrical surface is displaced a greater distance from said frusto-conical valve seat surface in said heat treated condition than in said initial condition and said outer cylindrical wall is displaced a volume proportional to the increase of said first volume, said movement not inducing a strain which exceeds the elastic limits of said valve seat insert.

7. The combination of claim 1 wherein said insert further includes recess means in said outer cylindrical surface for assuring movement of said second volume from said initial condition to said heat treated condition to maintain said press fit.

8. The combination of claim 7 wherein said movement of said outer cylindrical wall does not exceed the elastic limits of the material of said cylinder head.

9. The combination of claim 7 wherein said cylindrical outer surface of said insert in said initial condition is between 0.004 to 0.007" greater in diameter than the diameter of said outer cylindrical wall of said countersunk valve bore opening.

10. The combination of claim 9 wherein said movement of said outer cylindrical wall in said heat treated condition does not exceed the elastic limits of the material of said cylinder head.

11. The combination of claim 1 wherein said outer cylindrical surface is displaced a greater distance from said frusto-conical valve seat surface in said heat treated condition than in said initial condition and said outer cylindrical wall is displaced a volume proportional to the increase of said first volume.

12. The combination of claim 1 wherein said cylindrical outer surface of said insert in said initial condition is between 0.002 and 0.007" greater in diameter than the diameter of said outer cylindrical wall of said bore.

13. The combination of claim 1 wherein said insert has a frusto-conical surface formed at the intersection of said annular base surface and said outer cylindrical wall generally parallel to said frusto-conical seat surface.

14. The combination of claim 13 wherein said first distance plus second distance is approximately equal to the cross-sectional length of said top annular surface and is approximately equal to the cross-sectional length of said bottom annular surface.

15. A method of heat treating and retaining a ferrous valve seat insert in a countersunk valve bore of an engine component, said bore being defined by an outer cylindrical wall having a first diameter, said insert being defined by an inner frusto-conical valve seat surface, an outer cylindrical surface of diameter slightly greater than said bore's diameter, an annular blind recess extending from said outer surface towards said valve seat surface, the method comprising:

i. pressing said insert into said bore to establish an initial compressive loading between said outer cylindrical wall of said engine component and said inner cylindrical surface of said bore said initial compressive loading established solely by pressing said insert into said bore at ambient temperature said annular recess being distorted when said insert is pressed into said bore;

ii. inductively heating a predetermined first volume of said insert to a temperature at least equal to said austenitic temperature, said first volume extending from said frusto-conical seat surface towards said outer cylindrical wall a predetermined distance which is less than the distance from said frusto-conical surface to said outer cylindrical surface;

iii. quenching said insert at a rate sufficient to form a martensitic structure in said first volume (a) so that the volumetric growth from said martensitic structure produces a deformation in the volume of said insert which has not heated above said austenitic temperatures to maintain an acceptable compressive loading, and (b) to further distort said annular recess whereby said compressive loading is maintained after quenching.

16. The method of claim 15 wherein said engine component is a non-ferrous metal, and said heating step is insufficient to induce a thermal expansion in said non-ferrous metal which exceeds the elastic limit of said non-ferrous metal.

17. The method of claim 15 wherein upon completion of said induction heating step said frusto-conical surface is at the highest temperature, at said predetermined distance the temperature of said insert is at the critical temperature and the additional step is provided of coordinating said highest temperature, said distance and said cooling step so that said cooling step uniformly cools substantially all of said predetermined volume simultaneously.

18. The method of claim 17 wherein said coordinating step insures the cooling of said insert at said predetermined distance at a rate equal to or greater than the rate at which said frusto-conical surface is cooled.

19. The method of claim 15 wherein said volume that said insert is heated is correlated to the volume of said insert which is not heated to the critical temperature whereby thermal stress cracks in said insert are avoided.

20. The method of claim 19 wherein said correlation step further includes correlating the volume that said insert is heated to or above the critical temperature to that volume of said insert which is not heated to or above the critical temperature so that said volume which is not heated to or above the critical temperature elastically deforms under the strain induced by the martensitic expansion.

21. The method of claim 20 wherein said volume that said insert is heated is correlated to the volume of said insert which is not heated to the critical temperature whereby thermal stress cracks in said insert are avoided.

22. The method of claim 21 wherein said correlation step further includes correlating the volume that said insert is heated to or above the critical temperature to that volume of said insert which is not heated to or above the critical temperature so that said volume which is not heated to or above the critical temperature elastically deforms under the strain induced by the martensitic expansion.

23. The method of claim 15 wherein said induction heating step is effective to skin heating of said insert at said frusto-conical seat surface.

24. The method of claim 15 wherein said induction heating is effective to produce an initial band of unstable heat spaced away from said frusto-conical seat surface so that the temperature of the insert at said initial band is higher than the temperature of said insert at said frusto-conical surface.

25. The method of claim 15 wherein upon completion of said induction heating, said insert at said predetermined distance is at the highest temperature, said frusto-conical surface is at the critical temperature and the additional step is provided of coordinating said highest temperature, said distance and said cooling step so that said cooling step uniformly cools substantially all of said predetermined volume simultaneously.

26. The method of claim 15 wherein said predetermined distance extends to and contacts the bottom of said blind recess whereby said martensitic structure extends to the bottom of said recess to deform said recess whereby said recess deformation exerts additional pressure between said outer cylindrical surface and said outer cylindrical cover.

27. In combination, a cylinder head and an annular valve seat insert heat treated, in situ, from an initial condition to a heat treated condition by induction heating, said cylinder head having at least one combustion chamber, a cylindrical, countersunk valve bore in said head in communication with said combustion chamber, said countersunk valve bore defined by an annular base and an outer cylindrical wall extending therefrom; said insert within said bore having a bottom annular base surface in contact with said annular base, a smaller top annular surface, a generally cylindrical outer surface extending between said top and bottom annular surfaces in contact with said outer cylindrical wall and a frusto-conical seat surface extending from said top annular surface towards said bottom annular base surface the improvement comprising:

said initial condition established solely by a press fit condition at ambient temperature;

said insert having a first volume of a substantially martensitic grain structure defined by a cross-sectional configuration of said insert extending a predetermined first distance from said frusto-conical seat surface towards said outer cylindrical wall, a second volume of a substantially non-martensitic grain structure defined by a cross-sectional configuration extending a predetermined second distance from said cylindrical outer surface towards said frusto-conical valve seat surface;

said first volume greater in said heat treated condition than in said initial condition to maintain said outer cylindrical surface tightly against said outer cylindrical wall whereby the press fit force between said insert and said countersunk valve bore in said initial condition is at least maintained in said heat treated condition.

28. A method of heat-treating and retaining a ferrous valve seat insert in a countersunk valve bore of an engine component, said bore being defined by an outer cylindrical wall having a first diameter, said insert being defined by an inner frusto-conical valve seat surface, an outer cylindrical surface of diameter slightly greater than said bore's diameter, the method comprising:

i. pressing said insrt into said bore to establish an initial compressive loading between said outer cylindrical wall of said engine component and said inner cylindrical surface of said bore said initial compressive loading established solely by pressing said insert into said bore at ambient temperature;

ii. inductively heating a predetermined first volume of said insert to a temperature at least equal to said austenitic temperature, said first volume extending from said frusto-conical seat surface towards said outer cylindrical wall a predetermined distance which is less than the distance from said frusto-conical surface to said outer cylindrical surface;

iii. quenching said insert at a rate sufficient to form a martensitic structure in said first volume so that the volumetric growth from said martensitic structure produces a deformation in the volume of said insert which has not heated above said austenitic temperatures to maintain or increase said initial compressive loading.

* * * * *

UNITED STATES PATENT AND TRADEMARK OFFICE

CERTIFICATE OF CORRECTION

PATENT NO. : 4,791,259

DATED : December 13, 1988

INVENTOR(S) : George D. Pfaffmann

It is certified that error appears in the above-identified patent and that said Letters Patent is hereby corrected as shown below:

Title page, item [56] References Cited, after 4,643,781, "1/1987" should read --- 2/1987 ---. In the drawings, Sheet 1, Fig. 4, "28" should read --- 24 ---; "32" should read --- 28 ---. Column 3, line 21,"treaded" should read --- treated ---; line 31, cancel "cylindrical"; line 56, "have" should read ---heat---. Column 4, line 38, "strin" should read --- strain ---. Column 5, lines 55-56, "chambers" should read --- chamber ---. Column 6, line 42, "ragne" should read --- range ---; line 68, "or" should read --- of ---. Column 7, line 4, "30" should read --- 40 ---. Column 12, line 46, "inner" should read --- outer --- "bore" should read --- insert ---. Column 14, line 2, "cover" should read --- wall ---; line 45, "insrt" should read --- insert ---; line 48, "inner" should read --- outer ---; "bore" should read --- wall ---.

Signed and Sealed this

Twenty-fourth Day of July, 1990

*Attest:*

HARRY F. MANBECK, JR.

*Attesting Officer*

*Commissioner of Patents and Trademarks*